US012385505B2

(12) United States Patent
Bessho

(10) Patent No.: US 12,385,505 B2
(45) Date of Patent: Aug. 12, 2025

(54) CENTRIFUGAL COMPRESSOR

(71) Applicant: IHI Corporation, Tokyo (JP)

(72) Inventor: Yasutaka Bessho, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 18/823,380

(22) Filed: Sep. 3, 2024

(65) Prior Publication Data

US 2024/0418185 A1 Dec. 19, 2024

Related U.S. Application Data

(63) Continuation of application No. PCT/JP2022/048015, filed on Dec. 26, 2022.

(30) Foreign Application Priority Data

Apr. 22, 2022 (JP) ..... 2022-070654

(51) Int. Cl.
*F04D 29/68* (2006.01)
*F04D 17/10* (2006.01)
(Continued)

(52) U.S. Cl.
CPC ..... *F04D 29/685* (2013.01); *F04D 17/10* (2013.01); *F04D 29/4213* (2013.01); *F04D 29/66* (2013.01)

(58) Field of Classification Search
CPC ..... F04D 29/4213; F04D 29/685; F05D 2250/51; F05D 2220/40; F05D 2270/101
See application file for complete search history.

(56) References Cited

U.S. PATENT DOCUMENTS 5,295,785 A * 3/1994 Church ..... F04D 29/685 415/58.4
5,333,990 A * 8/1994 Foerster ..... F04D 29/685 415/58.4
(Continued)

FOREIGN PATENT DOCUMENTS

JP 2003-106299 A 4/2003
JP 2007-127108 A 5/2007
(Continued)

OTHER PUBLICATIONS

International Search Report issued Jan. 31, 2023 in PCT/JP2022/048015 filed Dec. 26, 2022 2 pages.

*Primary Examiner* — Justin D Seabe
(74) *Attorney, Agent, or Firm* — Oblon, McClelland, Maier & Neustadt, L.L.P.

(57) ABSTRACT

A centrifugal compressor includes: an impeller; and a housing that accommodates the impeller, the housing including: a primary flow path that accommodates the impeller; and a secondary flow path that surrounds the primary flow path in a cross-section perpendicular to an axial direction of the impeller, the secondary flow path including: a first end that opens to the primary flow path at a position upstream of the impeller in a flow of air in the primary flow path; and a second end that opens to the primary flow path at a position downstream of the first end, the first end opening to the primary flow path in a direction opposite to the impeller in the axial direction of the impeller, the second flow path including a throttle that is continuous with the first end and that is narrowed toward the first end.

5 Claims, 10 Drawing Sheets

(51) Int. Cl.
*F04D 29/42* (2006.01)
*F04D 29/66* (2006.01)

(56) References Cited

U.S. PATENT DOCUMENTS

| | | | | |
|---|---|---|---|---|
| 7,475,539 | B2 * | 1/2009 | Chen | F04D 27/0207 415/58.4 |
| 8,197,188 | B2 * | 6/2012 | Clay | F04D 25/04 415/119 |
| 10,436,218 | B2 * | 10/2019 | Ozaki | F04D 29/685 |
| 2009/0263234 | A1 | 10/2009 | Yin | |
| 2013/0302155 | A1 * | 11/2013 | Tamaki | F04D 29/441 415/203 |
| 2016/0017791 | A1 | 1/2016 | Nakao | |
| 2018/0073515 | A1 | 3/2018 | Kanzaka | |
| 2019/0010958 | A1 | 1/2019 | Wang et al. | |
| 2020/0032817 | A1 | 1/2020 | Ueno | |
| 2020/0109719 | A1 | 4/2020 | Fujiwara et al. | |

FOREIGN PATENT DOCUMENTS

| | | | |
|---|---|---|---|
| JP | 2014-202103 | A | 10/2014 |
| JP | 2016-29273 | A | 3/2016 |
| JP | 6865604 | B | 4/2021 |
| JP | 2021-95882 | A | 6/2021 |
| WO | WO 2016/151689 | A1 | 9/2016 |
| WO | WO 2017/138199 | A1 | 8/2017 |
| WO | WO 2018/198808 | A | 11/2018 |
| WO | WO 2019/004386 | A1 | 1/2019 |

* cited by examiner

CENTRIFUGAL COMPRESSOR

CROSS REFERENCE TO RELATED APPLICATIONS

This application is a continuation application of International Application No. PCT/JP2022/048015, filed on Dec. 26, 2022, which claims priority to Japanese Patent Application No. 2022-70654 filed on Apr. 22, 2022, the entire contents of which are incorporated herein by reference.

BACKGROUND ART

Technical Field

The present disclosure relates to a centrifugal compressor.

In a centrifugal compressor, a secondary flow path may be formed in addition to a primary flow path (see, for example, Patent Literatures 1 to 5). A compressor impeller is arranged in the primary flow path. A first end of the secondary flow path is connected to the primary flow path at a position upstream of the compressor impeller. A second end of the secondary flow path is connected to the primary flow path at a position downstream of the first end. In low-flow rate range, a part of air pressurized by the compressor impeller may flow backward in the primary flow path. This is referred to as a surge, and limits working range of the centrifugal compressor in the low-flow rate range. However, in the centrifugal compressor with the secondary flow path, a part of the air enters the secondary flow path from the second end, and returns to the primary flow path from the first end. According to such a configuration, the effect of surge can be reduced, and the working range in the low-flow rate range can be expanded.

CITATION LIST

Patent Literature

Patent Literature 1: US 2009/0263234 A
Patent Literature 2: JP 6865604 B
Patent Literature 3: JP 2014-202103 A
Patent Literature 4: WO 2019/004386 A
Patent Literature 5: JP 2021-95882 A

Technical Problem

In a centrifugal compressor, it is desirable to further improve efficiency in low-flow rate range.

The purpose of the present disclosure is to provide a centrifugal compressor that can improve efficiency in low-flow rate range.

Solution to Problem

To solve the above problem, a centrifugal compressor according to an aspect of the present disclosure includes an impeller, and a housing that accommodates the impeller, the housing including a primary flow path that accommodates the impeller, and a secondary flow path that surrounds the primary flow path in a cross-section perpendicular to an axial direction of the impeller, the secondary flow path including a first end that opens to the primary flow path at a position upstream of the impeller in a flow of air in the primary flow path, and a second end that opens to the primary flow path at a position downstream of the first end, the first end opening to the primary flow path in a direction opposite to the impeller in the axial direction of the impeller, and the secondary flow path including an throttle that is continuous with the first end and that is narrowed toward the first end.

The secondary flow path may include a plurality of fins arranged along a circumferential direction of the impeller.

The plurality of fins may be provided in the throttle of the secondary flow path.

Each of the plurality of fins may be tilted with respect to a central axis of the impeller when seen in a radial direction of the impeller.

Each of the plurality of fins may be tilted in the same direction as leading edges of blades of the impeller when seen in the radial direction.

Effects of Disclosure

According to the present disclosure, efficiency in low-flow rate range can be improved.

DESCRIPTION OF EMBODIMENTS

An embodiment of the present disclosure will be described in detail below with reference to the accompanying drawings. Specific dimensions, materials, and numerical values described in the embodiment are merely examples for a better understanding, and do not limit the present disclosure unless otherwise specified. In this specification and the drawings, duplicate explanations are omitted for elements having substantially the same functions and configurations by assigning the same sign. Furthermore, elements not directly related to the present disclosure are omitted from the figures.

Figure 1:
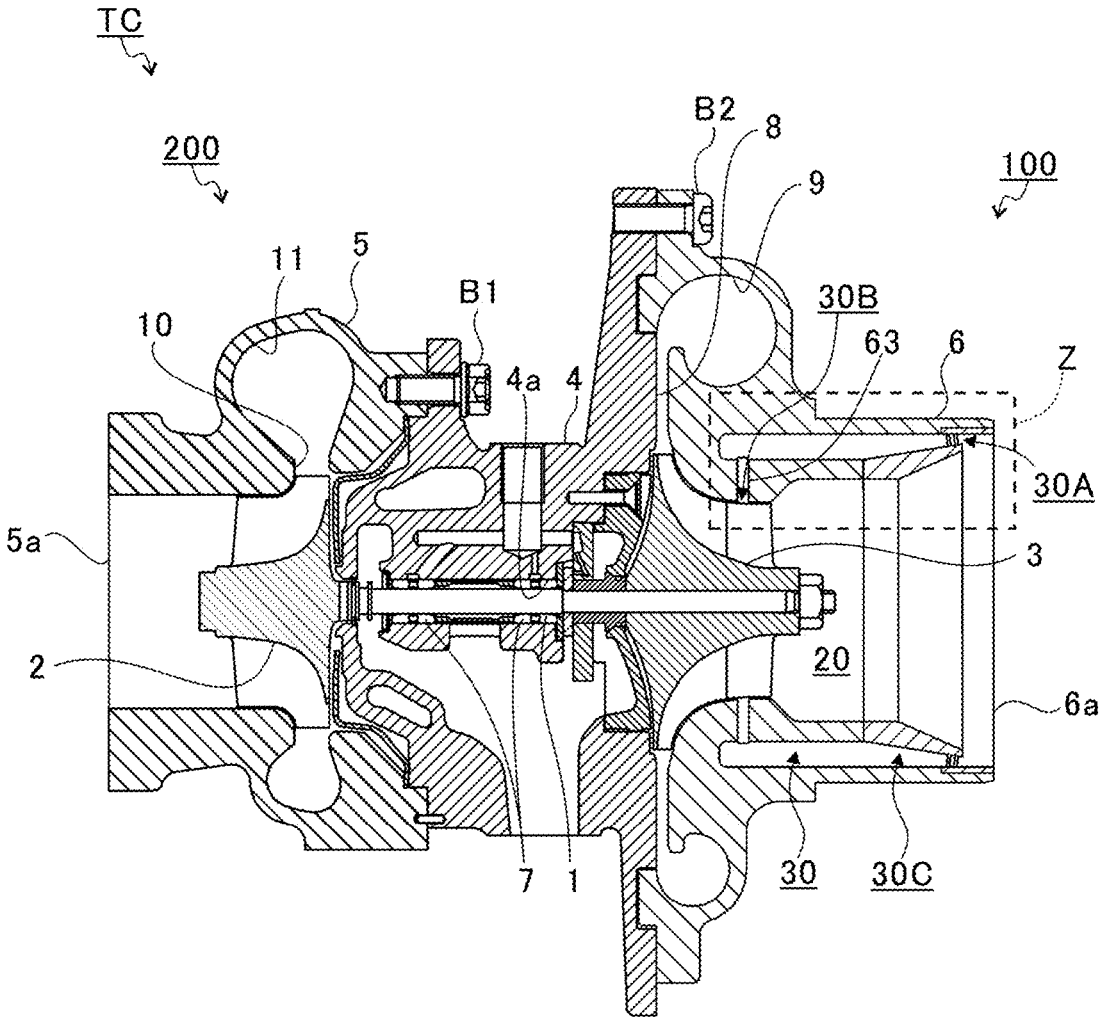
FIG. 1 is a schematical cross-sectional view of a turbocharger including a centrifugal compressor according to an embodiment.

FIG. 1 is a schematical cross-sectional view of a turbocharger TC including a centrifugal compressor 100 according to an embodiment. In the present embodiment, the centrifugal compressor 100 is incorporated into the turbocharger TC. In another embodiment, the centrifugal compressor 100 may be incorporated into a device other than the turbocharger TC, or may be a stand-alone device.

The turbocharger TC comprises a shaft 1, a turbine impeller 2, and a compressor impeller (impeller) 3. As described later, the shaft 1, the turbine impeller 2, and the compressor impeller 3 rotate integrally. As such, in the present disclosure, an "axial direction," a "radial direction," and a "circumferential direction" of the shaft 1, the turbine impeller 2, and the compressor impeller 3 may simply be referred to as the "axial direction," the "radial direction," and the "circumferential direction," respectively.

The turbocharger TC includes a bearing housing 4, a turbine housing 5, and a compressor housing (housing) 6. In the axial direction, the turbine housing 5 is connected to a first end face of the bearing housing 4 (a left end face in FIG. 1) by fastening bolts B1. In the axial direction, the compressor housing 6 is connected to a second end face of the bearing housing 4 (a right end face in FIG. 2) by fastening bolts B2.

The bearing housing 4 includes a bearing hole 4. The bearing hole 4*a* extends in the axial direction in the bearing housing 4. The bearing hole 4*a* accommodates a bearing 7. In the present embodiment, a full floating bearing is shown as an example of the bearing 7. In another embodiment, the bearing 7 may be other radial bearing such as a semi-floating bearing or a rolling bearing. The bearing 7 rotatably supports the shaft 1.

In the axial direction, a first end of the shaft 1 (a left end in FIG. 1) is provided with the turbine impeller 2. The turbine impeller 2 rotates integrally with the shaft 1. The turbine impeller 2 is rotatably accommodated in the turbine housing 5. In the axial direction, a second end of the shaft 1 (a right end in FIG. 1) is provided with the compressor impeller 3. The compressor impeller 3 rotates integrally with the shaft 1. The compressor impeller 3 is rotatably accommodated in the compressor housing 6.

The compressor housing 6 includes an inlet 6*a* at an end opposite to the bearing housing 4 in the axial direction. The inlet 6*a* is connected to an air cleaner (not shown). The compressor housing 6 also includes a primary flow path 20 and a secondary flow path 30. The primary flow path 20 and secondary flow path 30 are described in detail below. The compressor impeller 3 is arranged in the primary flow path 20.

The bearing housing 4 and the compressor housing 6 define a diffuser flow path 8 therebetween. The diffuser flow path 8 extends from an inner side to an outer side in the radial direction. The diffuser flow path 8 has an annular shape. The diffuser flow path 8 communicates with the inlet 6*a* via the compressor impeller 3.

The compressor housing 6 includes a compressor scroll flow path 9. The compressor scroll flow path 9 is located at a radially outer side with respect to the diffuser flow path 8. The compressor scroll flow path 9 communicates with the diffuser flow path 8. The compressor scroll flow path 9 also communicates with an intake port of an intercooler (not shown).

In the compressor housing 6 as described above, when the compressor impeller 3 rotates, air is sucked into the primary flow path 20 from the inlet 6*a*. The sucked air is accelerated and pressurized by centrifugal force while passing through blades of the compressor impeller 3. The air is further pressurized in the diffuser flow path 8 and the compressor scroll flow path 9. The pressurized air flows out of an outlet (not shown), and is directed to the intake port of the intercooler. In the turbocharger TC, a portion including the compressor impeller 3 and the compressor housing 6 functions as the centrifugal compressor 100.

In the present disclosure, an upstream side in the flow of the sucked air in the primary flow path 20 may simply be referred to as the "upstream side," and a downstream side in the flow of the sucked air in the primary flow path 20 may simply be referred to as the "downstream side," with regard to the centrifugal compressor 100 and its components.

The turbine housing 5 includes an outlet 5*a* at an end opposite to the bearing housing 4 in the axial direction. The outlet 5*a* is connected to an exhaust gas purifier (not shown). The turbine housing 5 includes a connecting flow path 10. The connecting flow path 10 extends from an inner side to an outer side in the radial direction. The connecting flow path 10 has an annular shape. The connecting flow path 10 communicates with the outlet 5*a* via the turbine impeller 2.

Turbine housing 5 includes a turbine scroll flow path 11. The turbine scroll flow path 11 is located at a radially outer side with respect to the connecting flow path 10. The turbine scroll flow path 11 communicates with the connecting flow path 10. The turbine scroll flow path 11 also communicates with a gas inlet (not shown). The gas inlet receives exhaust gas discharged from an exhaust manifold of an engine (not shown).

In the turbine housing 5 as described above, the exhaust gas is directed from the gas inlet to the turbine scroll flow path 11, and is further directed to the outlet 5*a* via the connecting flow path 10 and the turbine impeller 2. The exhaust gas rotates the turbine impeller 2 while passing through blades of the turbine impeller 2. A rotational force of the turbine impeller 2 is transmitted to the compressor impeller 3 via the shaft 1. As the compressor impeller 3 rotates, the air is sucked into the inlet 6*a*, and is accelerated and pressurized by the compressor impeller 3, as described above. In the turbocharger TC, a portion including the turbine impeller 2 and the turbine housing 5 functions as a turbine 200.

Next, the primary flow path 20 and the secondary flow path 30 of the compressor housing 6 are described.

Figure 2:
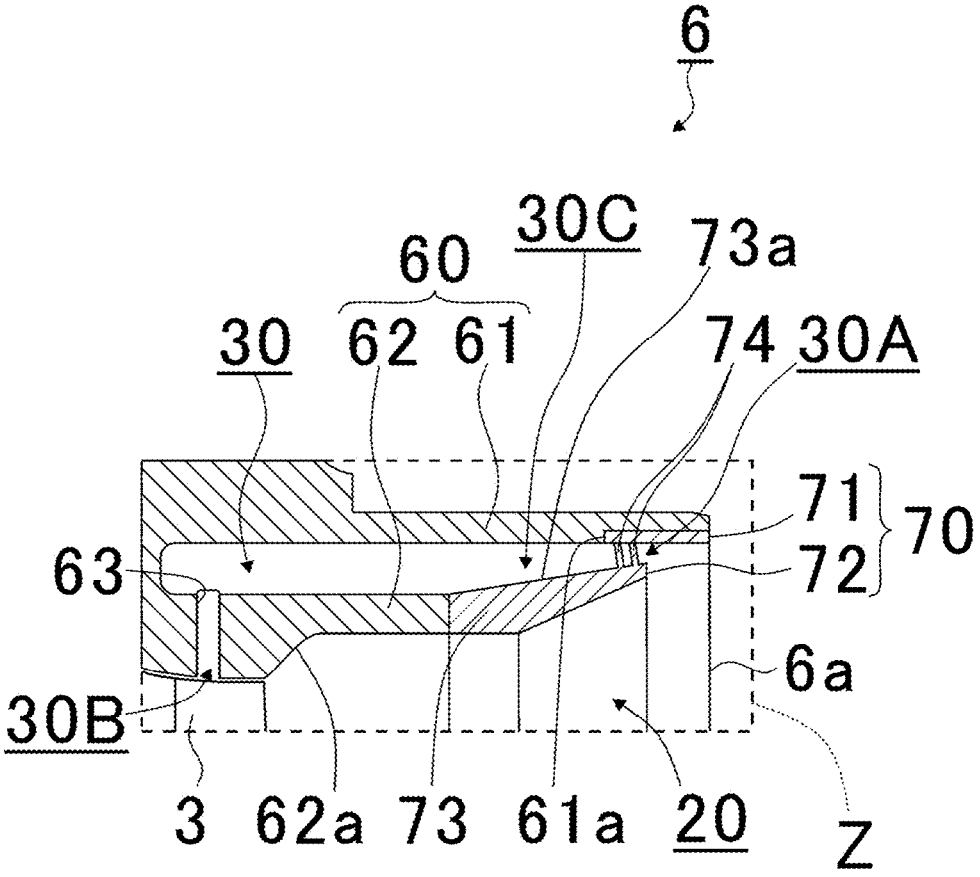
FIG. 2 is an enlarged cross-sectional view of section Z in FIG. 1.

FIG. 2 is an enlarged cross-sectional view of section Z in FIG. 1. The compressor housing 6 includes a main body 60 and an insert 70.

The main body 60 includes a first cylindrical portion 61 and a second cylindrical portion 62. Each of the first cylindrical portion 61 and the second cylindrical portion 62 has a substantially cylindrical shape.

A central axis of the first cylindrical portion 61 corresponds to the central axis of the compressor impeller 3. An inner diameter of the first cylindrical portion 61 is constant along the axial direction.

The second cylindrical portion 62 is formed in and coaxially with the first cylindrical portion 61. The first cylindrical portion 61 and the second cylindrical portion 62 are formed integrally. Upstream ends (right ends in FIG. 1) of the first cylindrical portion 61 and the second cylindrical portion 62 are opened. Downstream ends (left ends in FIG. 1) of the first cylindrical portion 61 and the second cylindrical portion 62 are connected to each other. In the axial direction, the second cylindrical portion 62 is shorter than the first cylindrical portion 61, and the upstream end of the second cylindrical portion 62 is located in the first cylindrical portion 61.

The outer diameter of the second cylindrical portion 62 is constant along the axial direction, and is smaller than the inner diameter of the first cylindrical portion 61. Accordingly, a gap is formed between the first cylindrical portion 61 and the second cylindrical portion 62 in the radial direction. An inner surface of the second cylindrical portion 62 includes a tapered portion 62*a* that is tapered from the upstream side toward the downstream side.

The second cylindrical portion 62 includes a slit 63. The slit 63 penetrates the second cylindrical portion 62 in the radial direction. For example, the slit 63 may extend in the circumferential direction, and may be discontinuous in the circumferential direction. A material of this discontinuous part (rib) connects portions on both sides of the slit 63 along the axial direction. Furthermore, for example, the slit 63 may extend in the circumferential direction, and may be continuous in the circumferential direction (i.e., continuous over the entire circumference). In this case, in order to connect the first cylindrical portion 61 and the second cylindrical portion 62, a material (rib) that is a discontinuous portion in the circumferential direction is provided in a radial gap between the first cylindrical portion 61 and the second cylindrical portion 62.

The insert 70 is arranged in the first cylindrical portion 61. In the present embodiment, the insert 70 includes a first insert 71 and a second insert 72.

The first insert 71 has a cylindrical shape. The first insert 71 is coaxially fitted in the first cylindrical portion 61. The first cylindrical portion 61 includes a counterbore 61*a* into which the first insert 71 is fitted. In the radial direction, an inner wall of the first insert 71 is formed to be flush with an inner wall of the first cylindrical portion 61. An inner diameter of the first insert 71 is constant along the axial direction. The first insert 71 is flush with an end face of the first cylindrical portion 61 in the axial direction, and defines the inlet 6*a*. In another embodiment, the first insert 71 may be retracted or protrude from the end face of the first cylindrical portion 61 in the axial direction.

The second insert 72 includes a body 73 and a plurality of fins 74.

The body 73 is coaxially arranged in the first cylindrical portion 61. An outer surface of the body 73 includes a tapered portion 73*a* that is tapered from the upstream side to the downstream side. For example, in the present embodiment, the body 73 has a substantially hollow truncated cone shape. A downstream end of the body 73 (left end in FIG. 2) has a smaller diameter, and contacts an end of the second cylindrical portion 62. An upstream end of the body 73 (right end in FIG. 2) has a larger diameter, and is located in the first insert 71. An outer diameter of the body 73 is smaller than the inner diameters of the first cylindrical portion 61 and the first insert 71. Accordingly, a gap is formed in the radial direction between the first cylindrical portion 61 and the first insert 71 and the body 73.

The gap between the first cylindrical portion 61 and the first insert 71 and the body 73, the gap between the first cylindrical portion 61 and the second cylindrical portion 62, and the slit 63 as described above serve as the secondary flow path 30.

In the first cylindrical portion 61, a space other than the secondary flow path 30 functions as the primary flow path 20. Specifically, a space from the inlet 6*a* to the upstream end of the body 73 in the first insert 71, a space in the second insert 72, and a space in the second cylindrical portion 62 function as the primary flow path 20. The primary flow path 20 extends from the inlet 6*a* to a radially inner end of the diffuser flow path 8. The secondary flow path 30 is located outside the primary flow path 20 in the radial direction in a cross-section perpendicular to the axial direction.

A radial gap between the upstream end of the body 73 and the first insert 71 serves as a first end 30A of the secondary flow path 30. Referring to FIG. 1, the first end 30A opens to the primary flow path 20 at a position upstream of the compressor impeller 3. Furthermore, in the axial direction, the first end 30A opens to the primary flow path in a direction opposite to the compressor impeller 3.

Referring to FIG. 2, a radially inner end of the slit 63 serves as a second end 30B of the secondary flow path 30. The second end 30B opens to the primary flow path 20 at a position downstream of the first end 30A. In the present embodiment, the second end 30B opens to the primary flow path inwardly in the radial direction. In the present embodiment, the second end 30B faces the compressor impeller 3 in the radial direction.

The secondary flow path 30 includes a throttle 30C that is continuous with the first end 30A and narrowed toward the first end 30A. Specifically, as described above, in the present embodiment, the inner diameters of the first cylindrical portion 61 and the first insert 71 are constant along the axial direction, and the outer surface of the body 73 includes a tapered portion 73*a* that is tapered from the upstream side toward the downstream side. Accordingly, a space that is radially outside the tapered portion 73*a* functions as the throttle 30C.

Figure 3:
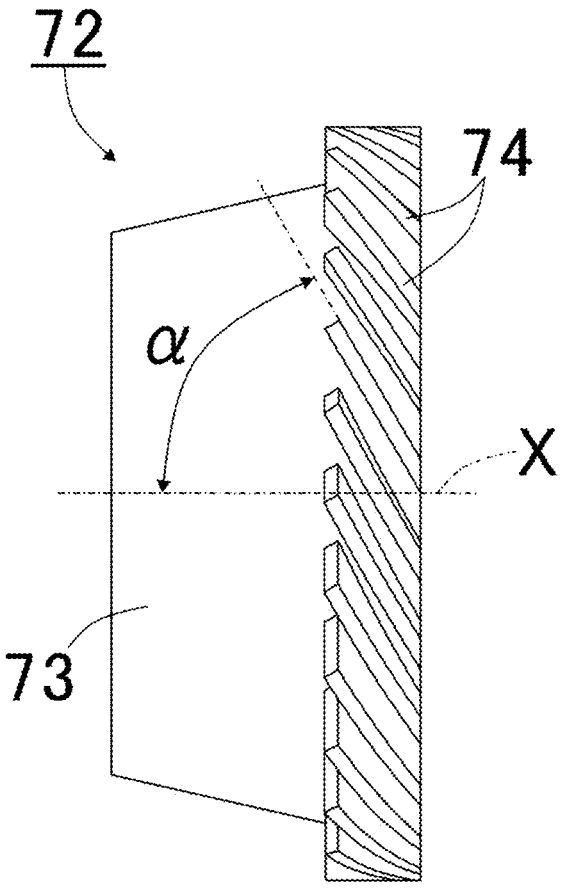
FIG. 3 is a side view of a second insert seen in a radial direction.

FIG. 3 is a side view of the second insert 72 seen in the radial direction. The plurality of fins 74 are arranged along the circumferential direction. The fins 74 project radially outward from the outer surface of the body 73. The fins 74 are tilted with respect to the central axis X of the compressor impeller 3 when seen in the radial direction. An angle between the fin 74 and the central axis X is defined as a. In the present embodiment, the fins 74 are tilted in the same direction as leading edges of the compressor impeller 3 when seen in the radial direction.

Referring to FIG. 2, radially outer ends of the fins 74 contact the inner surface of the first insert 71. The second insert 72 is fitted to the inner surface of the first insert 71 by the fins 74. The fins 74 fix the second insert 72 to the first insert 71.

Regarding an assembly of the first insert 71 and the second insert 72, the first insert 71 is fitted into the counterbore 61*a* at first. Then, the fins 74 of the second insert 72 are fitted into the inner surface of the first insert 71. This order allows the first insert 71 and the second insert 72 to be assembled into the main body 60.

Next, a work of the centrifugal compressor 100 is described.

Firstly, a work in low-flow rate range is described.

As described above, when the compressor impeller 3 rotates, air is sucked into the primary flow path 20 from the inlet 6*a*. The sucked air is pressurized by centrifugal force while passing through the blades of the compressor impeller 3.

In the low-flow rate range, when a pressure at an inlet of the compressor impeller 3 is less than a pressure at an outlet of the compressor impeller 3, a part of the pressurized air is pushed back from the outlet of the compressor impeller 3 toward the inlet of the compressor impeller 3 due to a pressure gradient being reversed. This air flows backward in the primary flow path 20. However, since the centrifugal compressor 100 includes the secondary flow path 30, the air flowing backward in the primary flow path 20 enters the secondary flow path 30 from the second end 30B. This curbs the effect of surge, and expands working range of the centrifugal compressor 100 in the low-flow rate range.

The air entering the secondary flow path 30 returns to the primary flow path 20 from the first end 30A. However, in the present embodiment, the secondary flow path includes the throttle 30C and the fins 74 that are continuous with the first end 30A. The throttle 30C and the fins 74 impede the flow in the secondary flow path 30. Accordingly, the throttle 30C and the fins 74 can reduce the flow rate of air returning to the primary flow path 20. As such, in the present embodiment, the secondary flow path 30 functions as a buffer region for temporarily storing air. This is the opposite of the conventional configuration where air in the secondary flow path is actively returned to the primary flow path.

Furthermore, in the present embodiment, the first end 30A opens to the primary flow path 20 in the direction opposite to the compressor impeller 3 in the axial direction. Accordingly, the secondary flow path 30 is extended in the axial direction, compared to the case where the first end 30A opens to the primary flow path 20 in the radial direction, for example. As such, the secondary flow path 30 can store air longer.

According to the above configuration, the air pressurized by the compressor impeller 3 is stored in the secondary flow path 30 for a longer time. Therefore, the air is cooled off as its pressure decreases while the air is stored in the secondary flow path 30. As such, when returning to the primary flow path 20, the pressure and the temperature of the air in the secondary flow path 30 approaches the pressure and the temperature of the air flowing in the primary flow path 20. According to such a configuration, loss of flow in the primary flow path 20 can be reduced when the air in the secondary flow path 30 returns to the primary flow path 20. As such, efficiency in the low-flow rate range can be improved.

Furthermore, in the present embodiment, the fins 74 are tilted in the same direction as the leading edges of the compressor impeller 3 when seen in the radial direction. The air flowing in the primary flow path 20 is dragged by the rotation of the compressor impeller 3, and is swirled in the same direction as the rotation of the compressor impeller 3. In the present embodiment, since the fins 74 are tilted in the same direction as the leading edges of the compressor impeller 3, the air returning from the first end 30A to the primary flow path 20 is also swirled in the same direction as the rotation of the compressor impeller 3. Accordingly, the air returning to the primary flow path 20 from the first end 30A does not impede the flow in the primary flow path 20. As such, loss of flow in the primary flow path 20 can be reduced when the air in the secondary flow path 30 returns to the primary flow path 20. Thus, the efficiency in the low-flow rate range can be further improved.

Next, a work in high-flow rate range is described.

In the high-flow rate range, a portion of the air flowing in the primary flow path 20 enters the secondary flow path 30 from the first end 30A, contrary to in the low-flow rate range. However, in the present embodiment, the secondary flow path 30 includes the throttle 30C and the fins 74 that are continuous with the first end 30A. The throttle 30C and the fins 74 can reduce the flow rate of air entering the secondary flow path 30 from the first end 30A. The air entering the secondary flow path 30 returns to the primary flow path 20 from the second end 30B. In the present embodiment, a difference between a pressure of the air at the first end 30A and a pressure of the air at the second end 30B is relatively small, since the flow rate of the air entering the secondary flow path 30 from the first end 30A is reduced, as described above. According to such a configuration, when the air in the secondary flow path 30 returns to the primary flow path 20 from the second end 30B, loss of flow in the primary flow path 20 can be reduced. Accordingly, efficiency in the high-flow rate range can also be improved. Note that although the air returns to a position between the blades of the compressor impeller 3 when the air in the secondary flow path 30 returns to the primary flow path 20 from the second end 30B in the present embodiment, the air may return to a position upstream of the compressor impeller 3, as long as the air returns to the primary flow path 20.

Next, results of analyses of the centrifugal compressor 100 are described.

Figure 4:
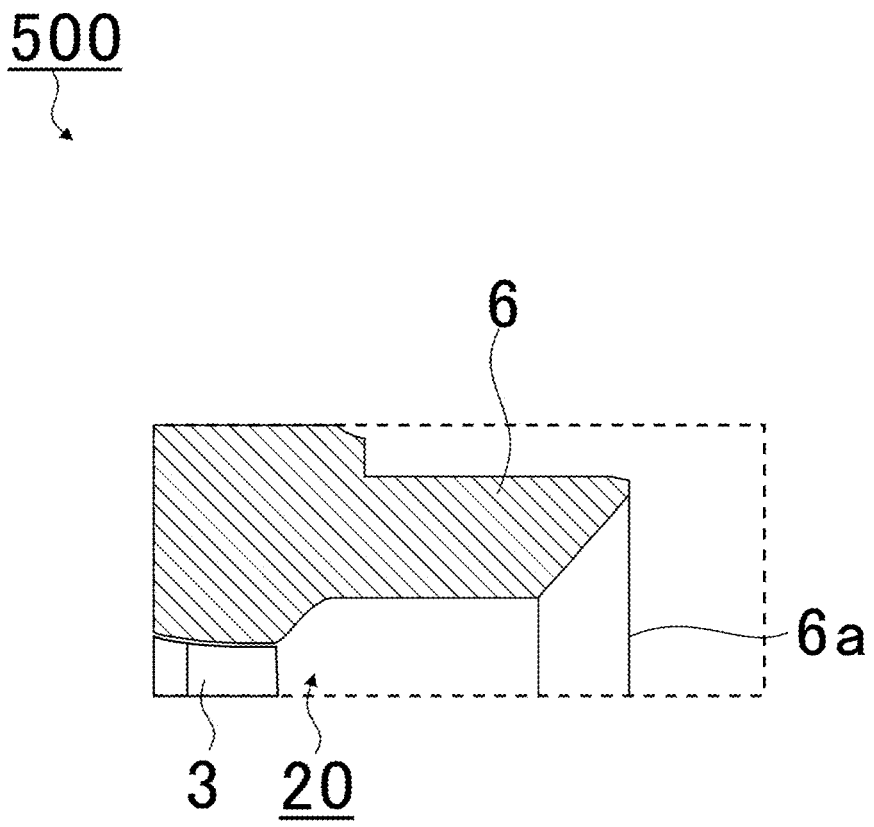
FIG. 4 is an enlarged cross-sectional view of a first comparative example.
Figure 5:
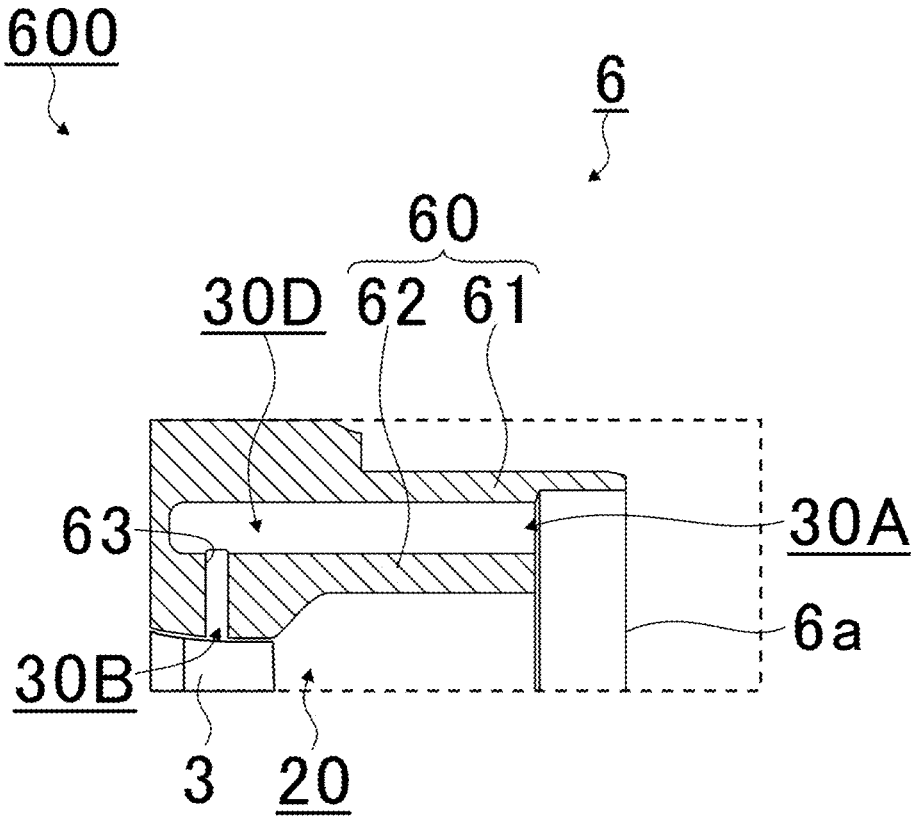
FIG. 5 is an enlarged cross-sectional view of a second comparative example.
Figure 6:
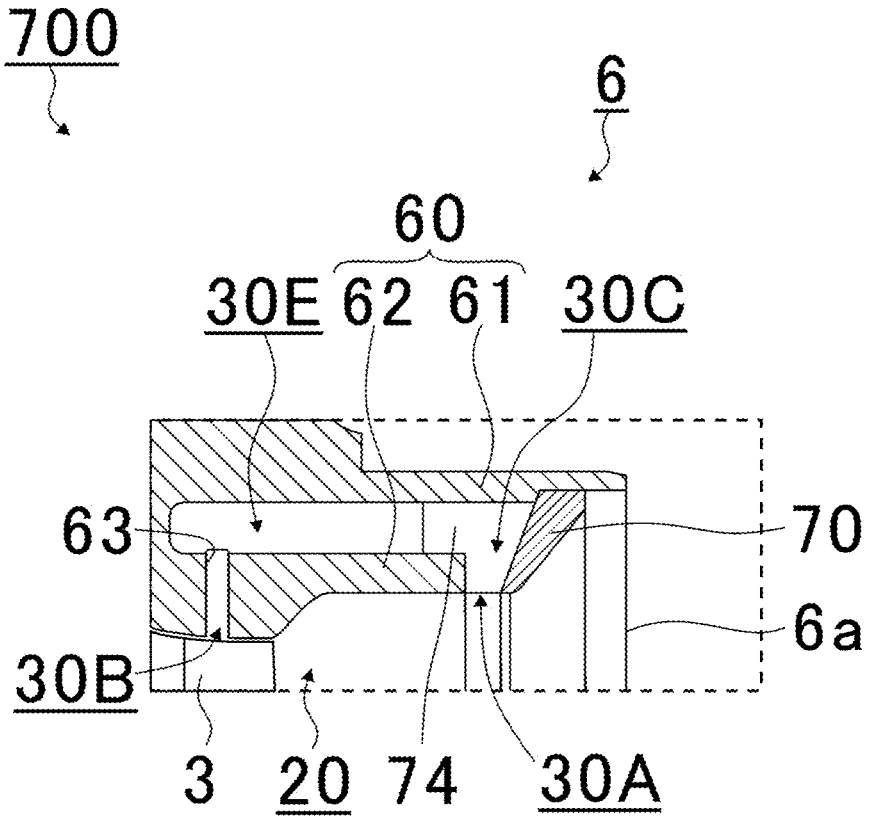
FIG. 6 is an enlarged cross-sectional view of a third comparative example.

FIGS. 4, 5 and 6 are enlarged cross-sectional views of first, second, and third comparative examples, respectively.

Referring to FIG. 4, a centrifugal compressor 500 for the first comparative example differs from the above-described centrifugal compressor 100 in that the centrifugal compressor 500 does not include a secondary flow path. The centrifugal compressor 500 may be substantially similar to the centrifugal compressor 100 in other respects.

Referring to FIG. 5, a centrifugal compressor 600 for the second comparative example differs from the above-described centrifugal compressor 100 in the configuration of the secondary flow path 30D. Specifically, the centrifugal compressor 600 does not include an insert. The secondary flow path 30D does not include a throttle, and the first end 30A opens wider to the primary flow path 20, compared to that in the centrifugal compressor 100. The centrifugal compressor 600 may be substantially similar to the centrifugal compressor 100 in other respects.

Referring to FIG. 6, a centrifugal compressor 700 for the third comparative example differs from the above-described centrifugal compressor 100 in the configuration of the secondary flow path 30E. Specifically, in the centrifugal compressor 700, the first end 30A opens to the primary flow path 20 in the radial direction. Accordingly, the secondary flow path 30E is shorter in the axial direction than the secondary flow path 30 of the above-described centrifugal compressor 100. The insert 70 is formed by a single component. The centrifugal compressor 700 may be substantially similar to the centrifugal compressor 100 in other respects.

Figure 7:
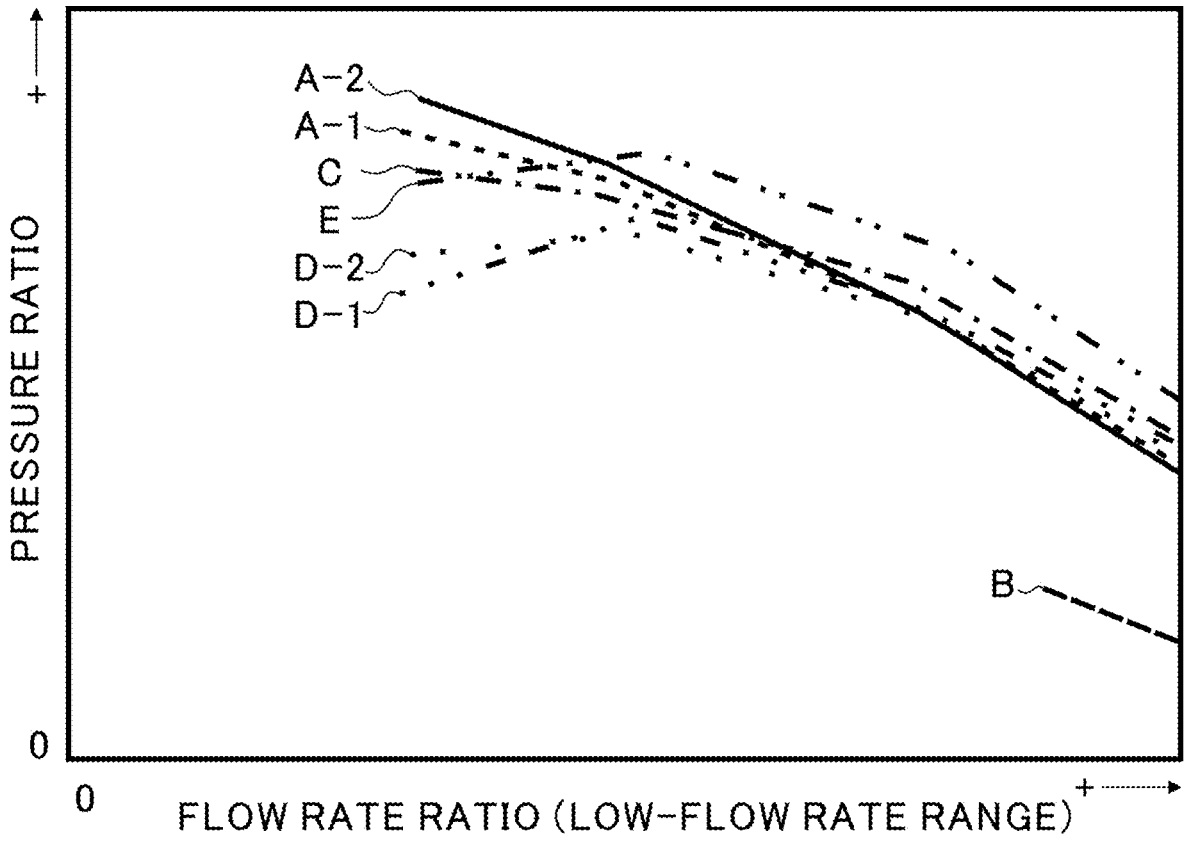
FIG. 7 shows results of analyses of pressure ratio in low-flow rate range.
Figure 8:
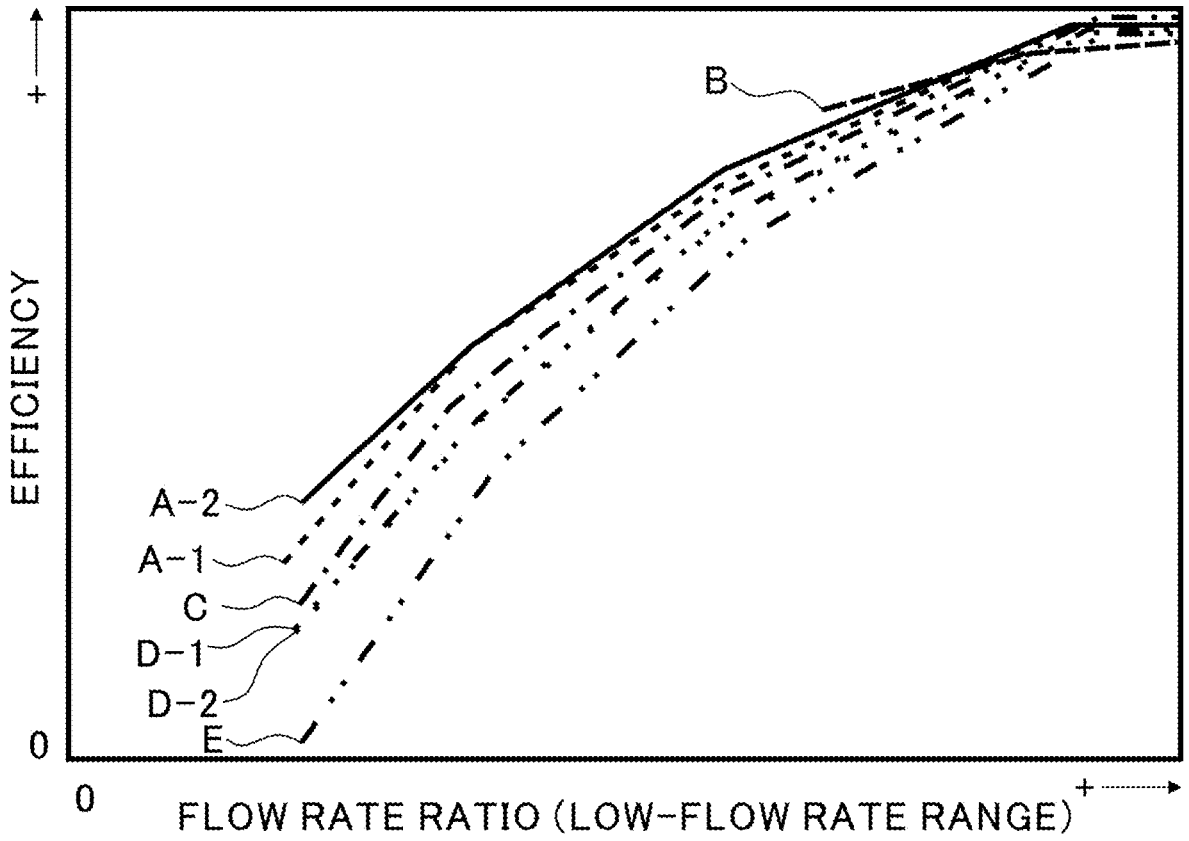
FIG. 8 shows results of analyses of efficiency in the low-flow rate range.
Figure 9:
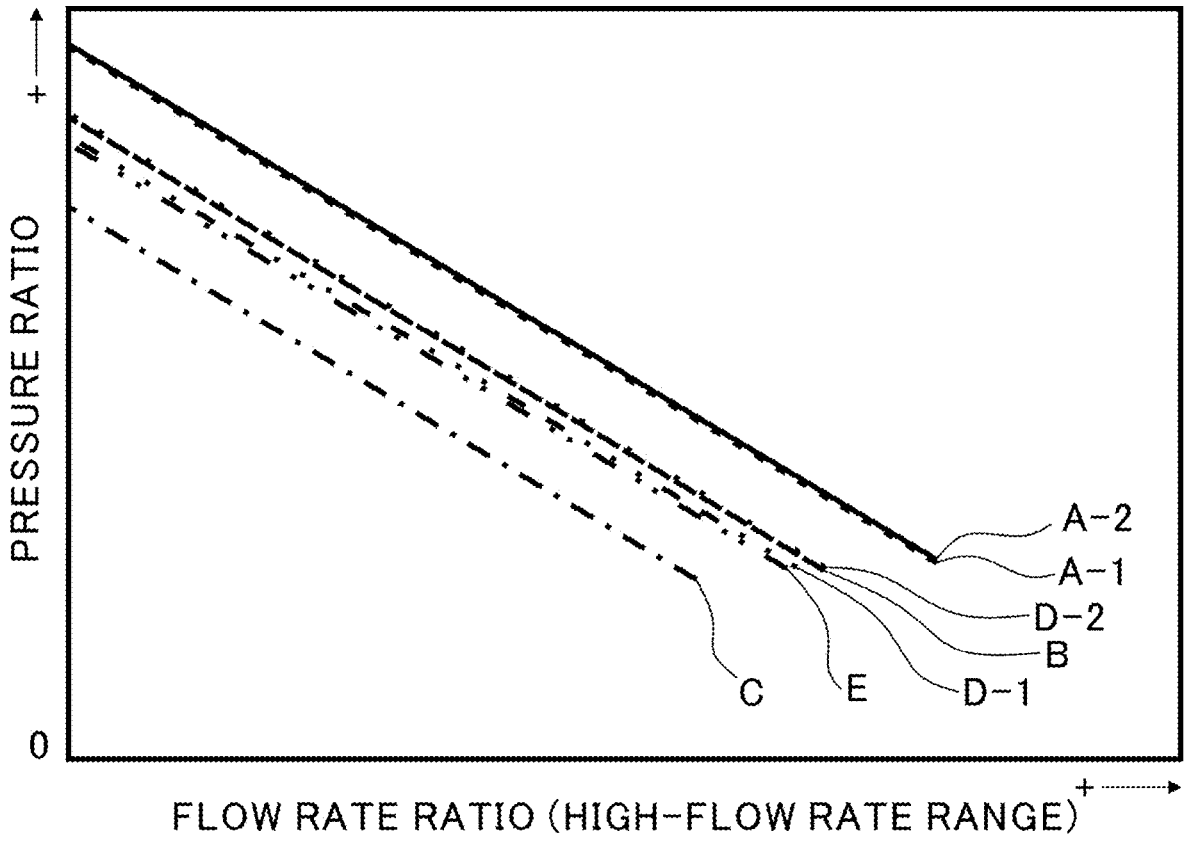
FIG. 9 shows results of analyses of pressure ratio in high-flow rate range.
Figure 10:
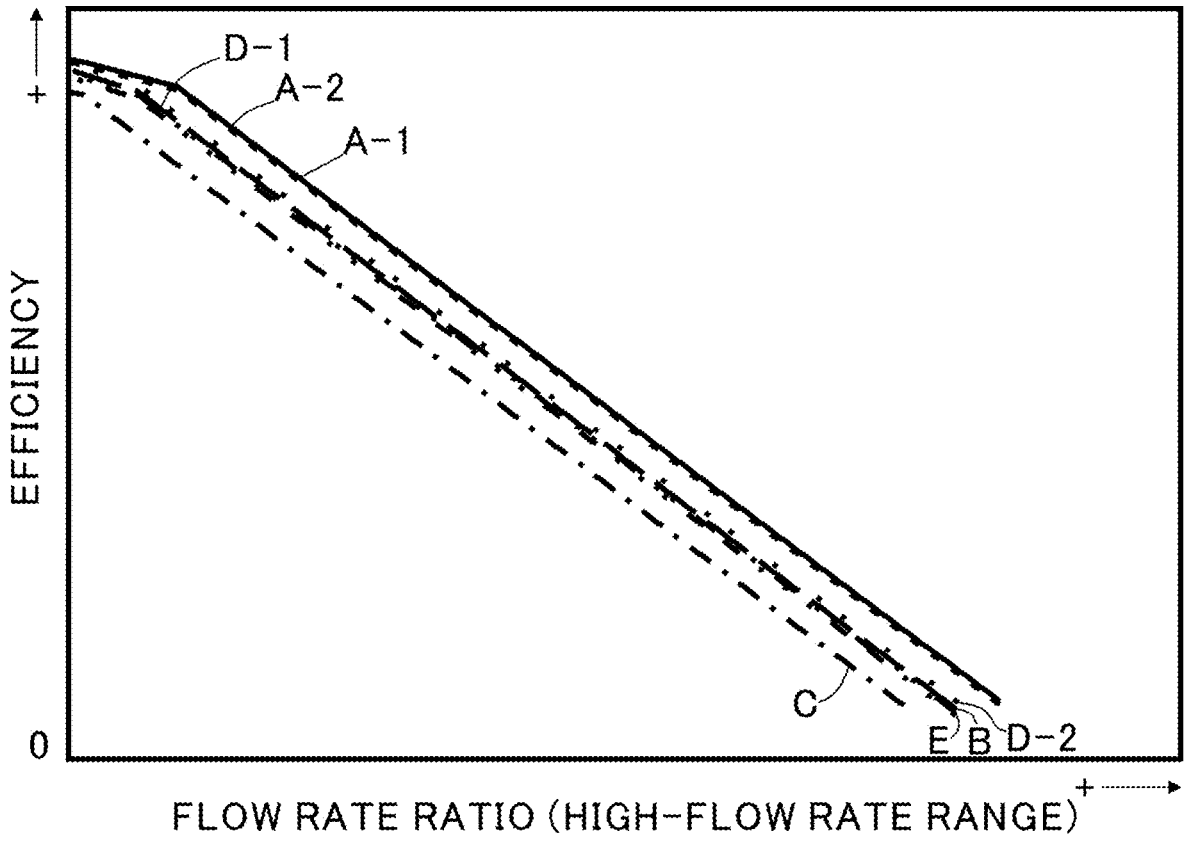
FIG. 10 shows results of analyses of efficiency in the high-flow rate range.

FIGS. 7 and 8 show results of analyses of pressure ratio and efficiency in low-flow rate range, respectively. FIGS. 9 and 10 show results of analyses of pressure ratio and efficiency in high-flow rate range, respectively. In FIGS. 7 to 10, the horizontal axis indicates the flow rate ratio. The vertical axis indicates the pressure ratio in FIGS. 7 and 9, and the efficiency in FIGS. 8 and 10.

The "pressure ratio" in FIGS. 7 and 9 is calculated by the following equation (1), where the pressure ratio is $P_{(tot)ratio}$, the pressure at the outlet of the compressor (total pressure) is $P_{(tot)out}$, and the pressure at the inlet of the compressor (total pressure) is $P_{(tot)in}$.

$$P_{(tot)ratio} = P_{(tot)out}/P_{(tot)in} \tag{1}$$

The "efficiency" in FIGS. 8 and 10 is calculated by the following equation (2), where the efficiency is $\eta_{(tot)}$, the pressure ratio is $P_{(tot)ratio}$, the specific heat ratio of air is $\gamma_{air}$, the temperature at the outlet of the compressor (total temperature) is $T_{(tot)out}$, and the temperature at the inlet of the compressor (total temperature) is $T_{(tot)in}$.

$$\eta_{(tot)} = \left(P_{(tot)ratio}\left(\gamma_{air} - 1/\gamma_{air}\right) - 1\right)/\left(T_{(tot)out}/T_{(tot)in} - 1\right) \tag{2}$$

For example, the "flow rate ratio" in FIGS. 7, 8, 9 and 10 is calculated as follows. Flow rates at all rotation rates used in the analyses are calculated for each of the example and the comparative examples. Among all of the calculated flow rates including both the example and the comparative examples, the maximum flow rate at any one rotation rate is extracted. By calculating a ratio between the extracted maximum flow rate and each flow rate at the same rotation rate, the "flow rate ratio" for each of the example and the comparative examples at any one rotation rate is calculated.

Properties of the centrifugal compressor 100 of the embodiment shown in FIG. 2 and the centrifugal compressors 500, 600 and 700 of the first, second, and third comparative examples shown in FIGS. 4 to 6 were analyzed with using a fluid analysis tool. Specifically, the pressure ratios and the efficiencies were calculated for each condition when air flows at a plurality of flow rates from the inlet 6*a* to the compressor impeller 3.

In FIGS. 7 to 10, Line A-1 and Line A-2 show results of analyses of Embodiments 1 and 2 of the present disclosure, respectively, corresponding to the centrifugal compressor 100 shown in FIG. 2. Embodiment 2 differs from Embodiment 1 in the angle α of the fin 74 and an area of the opening of the first end 30A.

Line B shows results of analyses of Comparative Example 1 corresponding to the centrifugal compressor 500 in FIG. 4 without a secondary flow path. Note that in FIGS. 7 and 8, Line B could not be analyzed at lower flow rates compared to the other conditions.

Line C shows results analyses of Comparative Example 2 corresponding to the centrifugal compressor 600 of FIG. 5, where the first end 30A of the secondary flow path 30D has a wide opening to the primary flow path 20.

Lines D-1, D-2 and E show results of analyses of Comparative Examples 3, 4 and 5, respectively, corresponding to the centrifugal compressor 700 of FIG. 6, where the first end 30A of the secondary flow path 30E opens in the radial direction. Comparative Example 4 differs from Comparative Example 3 in the radius from the central axis X to the first end 30A. In Comparative Examples 3 and 4, the fins 74 are oriented such that the air returned from the first end 30A to the primary flow path 20 is parallel to the axial direction (which can also be referred to as non-swirl). In Comparative Example 5, the fins 74 are oriented such that the air returned from the secondary flow path 30 to the primary flow path 20 is swirled in a direction opposite to the rotation of the compressor impeller 3 (which can also be referred to as counter-swirl).

Referring to FIG. 7, in the low-flow rate range, the pressure ratios of Embodiments 1 and 2 (lines A-1 and A-2) keep increasing as the flow rate decreases, compared to those of Comparative Examples 1 to 5 (lines B, C, D-1, D-2 and E). This means that a higher-pressure ratio can be retained in the low-flow rate range, and therefore the pressure at the inlet of the compressor impeller 3, which decreases as the flow rate decreases, can be maintained at a higher pressure. In other words, a critical flow rate range on a lower flow rate side (surge margin) can be expanded, and therefore the working range of the centrifugal compressor can be extended to a further lower flow rate side, compared to previously known structures.

Referring to FIG. 8, in the low-flow rate range, the efficiencies of Embodiments 1 and 2 (lines A-1 and A-2) are higher than those of Comparative Examples 2 to 5 (lines C, D-1, D-2 and E), except for Comparison Example 1 (line B). As such, according to Embodiments 1 and 2, the efficiency in the low-flow rate range can be improved.

Referring to FIG. 9, in the high-flow rate range, the pressure ratios of Embodiments 1 and 2 (lines A-1 and A-2) are higher than those of Comparative Examples 1 to 5 (lines B, C, D-1, D-2 and E). This means that the pressure ratio can be retained higher in the high-flow rate range, and therefore the pressure at the inlet of the compressor impeller 3, which decreases as the flow rate increases, can be maintained at a higher pressure, with respect to an exhaust pressure resistance at a side downstream of the compressor impeller 3. In other words, a critical flow rate range on a higher flow rate side (choke margin) can be expanded, and therefore the working range of the centrifugal compressor can be extended to a further higher flow rate side, compared to the previously known structure.

Referring to FIG. 10, in the high-flow rate range, the efficiencies of Embodiments 1 and 2 (lines A-1 and A-2) are higher than those of Comparative Examples 1 to 5 (lines B, C, D-1, D-2 and E). As such, according to Embodiments 1 and 2, the efficiency in the high-flow rate range can be improved.

The centrifugal compressor 100 of the present embodiment as described above comprises the compressor impeller 3 and the compressor housing 6 that accommodates the compressor impeller 3. The compressor housing 6 includes the primary flow path 20 that accommodates the compressor impeller 3 and the secondary flow path 30 that surrounds the primary flow path 20 in the cross-section perpendicular to the axial direction of the compressor impeller 3. The secondary flow path 30 includes the first end 30A that opens to the primary flow path 20 at the position upstream of the compressor impeller 3 in the flow of air in the primary flow path 20, and the second end 30B that opens to the primary flow path 20 at the position downstream of the first end 30A. The first end 30A opens to the primary flow path 20 in the direction opposite to the compressor impeller 3 in the axial direction, and the secondary flow path 30 includes the throttle 30C that is continuous with the first end 30A and narrowed toward the first end 30A. According to such a configuration, in the low-flow rate range, the air flowing backward in the primary flow path 20 enters the secondary flow path 30 from the second end 30B and returns to the primary flow path 20 from the first end 30A. However, the throttle 30C can reduce the flow rate of the air returning from the first end 30A to the primary flow path 20. Accordingly, the secondary flow path 30 functions as the buffer area for temporarily storing air. Furthermore, according to the above configuration, the first end 30A opens to the primary flow path 20 in the direction opposite to the compressor impeller 3 in the axial direction. Accordingly, the secondary flow path 30 is extended in the axial direction, as compared to the case where the first end 30A opens to the primary flow path 20 in the radial direction, for example. As such, the secondary flow path 30 can store air for a longer time. The air pressurized by the compressor impeller 3 is cooled off as its pressure decreases while stored in the secondary flow path 30. Accordingly, when returning to the primary flow path 20, the pressure and the temperature of the air in the secondary flow path 30 approaches the pressure and the temperature of the air flowing in the primary flow path 20. According to such a configuration, loss of flow in the primary flow path 20 can be reduced when the air in the secondary flow path 30 returns to the primary flow path 20 from the first end 30A. As such, the efficiency in the low-flow rate range can be improved.

In the high flow rate range, a part of the air flowing in the primary flow path 20 enters the secondary flow path 30 from the first end 30A, contrary to in the low-flow rate range. However, the throttle 30C can reduce the flow rate of the air entering the secondary flow path 30 from the first end 30A. According to such a configuration, the difference between the pressure of the air at the first end 30A and the pressure of the air at the second end 30B is relatively smaller. Therefore, when the air in the secondary flow path 30 returns to the primary flow path 20 from the second end 30B, loss of flow in the primary flow path 20 can be reduced. As such, the efficiency in the high-flow rate range can also be improved.

Furthermore, in the centrifugal compressor 100, the secondary flow path 30 includes the plurality of fins 74 arranged along the circumferential direction. The fins 74 can impede the flow of air in the secondary flow path 30, allowing the air to be stored longer in the secondary flow path 30. Accordingly, the efficiency in the low-flow rate range can be further improved.

Furthermore, in the centrifugal compressor 100, the plurality of fins 74 are provided in the throttle 30C of the secondary flow path 30. According to such a configuration, the fins 74 can reduce the flow rate of air entering the secondary flow path 30 from the first end 30A in the high-flow rate range. Accordingly, the efficiency in the high-flow rate range can be further improved.

Furthermore, in the centrifugal compressor 100, each of the plurality of fins 74 is tilted with respect to the central axis X of the compressor impeller 3 when seen in the radial direction. According to such a configuration, the fins 74 can impede the flow of air more in the secondary flow path 30, and can store the air in the secondary flow path 30 longer. Accordingly, the efficiency in the low-flow rate range can be further improved.

Furthermore, in the centrifugal compressor 100, each of the plurality of fins 74 is tilted in the same direction as the leading edges of the blades of the compressor impeller 3 when seen in the radial direction. According to such a configuration, the air returning to the primary flow path 20 from the first end 30A is swirled in the same direction as the rotation of the compressor impeller 3, i.e., the direction in which the air flowing in the primary flow path 20 is swirled. Accordingly, the air returning to the primary flow path 20 from the first end 30A does not impede the flow in the primary flow path 20. Therefore, loss of flow in the primary flow path 20 can be reduced when the air in the secondary flow path 30 returns to the primary flow path 20. As such, the efficiency in the low-flow rate range can be further improved.

Although the embodiment of the present disclosure has been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

What is claimed is:

1. A centrifugal compressor comprising:

an impeller; and a housing that accommodates the impeller, the housing including:

a primary flow path that accommodates the impeller; and a secondary flow path that surrounds the primary flow path in a cross-section perpendicular to an axial direction of the impeller, the secondary flow path including:

a first end that opens to the primary flow path at a position upstream of the impeller in a flow of air in the primary flow path, a second end that opens to the primary flow path at a position downstream of the first end, an outer circumferential wall that has a constant inner diameter along the axial direction of the secondary flow path, and an inner circumferential wall that includes a constant diameter portion that has a constant outer diameter along the axial direction of the secondary flow path and a tapered portion upstream of the constant diameter portion that is tapered toward the second end, wherein the first end opens toward a direction that is opposite to the impeller in the axial direction, the secondary flow path includes a throttle that is continuous with the first end and that is narrowed toward the first end, and the throttle is defined between the outer circumferential wall and the tapered portion of the inner circumferential wall.

2. The centrifugal compressor according to claim 1, wherein the secondary flow path includes a plurality of fins arranged along a circumferential direction of the impeller.

3. The centrifugal compressor according to claim 2, wherein the plurality of fins are provided in the throttle of the secondary flow path.

4. The centrifugal compressor according to claim 2, wherein each of the plurality of fins is tilted with respect to a central axis of the impeller when seen in a radial direction of the impeller.

5. The centrifugal compressor according to claim 4, wherein each of the plurality of fins is tilted in the same direction as leading edges of blades of the impeller when seen in the radial direction.

* * * * *